United States Patent [19]

Duchemin

[11] 4,353,503

[45] Oct. 12, 1982

[54] RESILIENT MOUNTING FOR A RAIL ON ITS SUPPORT

[75] Inventor: Michel Duchemin, Lambres Les Douai, France

[73] Assignee: Societe: Ressorts Industrie, Paris, France

[21] Appl. No.: 145,498

[22] Filed: Apr. 29, 1980

Related U.S. Application Data

[63] Continuation-in-part of Ser. No. 914,086, Sep. 9, 1978, abandoned.

[30] Foreign Application Priority Data

Dec. 16, 1977 [FR] France ..... 77 38124

[51] Int. Cl.[3] ..... E01B 9/30

[52] U.S. Cl. ..... 238/349; 238/338

[58] Field of Search ..... 238/310, 315, 338, 349

[56] References Cited

U.S. PATENT DOCUMENTS

| | | | |
|---|---|---|---|
| 1,839,725 | 1/1932 | Armstrong | 238/349 X |
| 3,610,526 | 10/1971 | Burwell | 238/349 X |
| 3,688,984 | 9/1972 | Sonneville | 238/349 |
| 4,054,247 | 10/1977 | Duchemin | 238/349 |
| 4,066,212 | 1/1978 | Sonneville | 238/349 |

FOREIGN PATENT DOCUMENTS

| | | | |
|---|---|---|---|
| 1300112 | 6/1962 | France | 238/349 |
| 522414 | 6/1940 | United Kingdom | 238/349 |
| 841438 | 7/1960 | United Kingdom | 238/315 |

*Primary Examiner*—Randolph A. Reese

*Attorney, Agent, or Firm*—Mason, Fenwick & Lawrence

[57] ABSTRACT

A resilient mounting for a rail on a concrete sleeper which has a flexible liner between the ground or base flange of the rail and the sleeper and a mounting clamp on opposite sides of the base flange forming a flexible nylon or polyacetal resin rail restrainer which overlies and engages the base flange and the sleeper. A bowed spring plate overlies the rail restrainer and overhangs beyond the edge of the restrainer above the base flange of the rail, with a clamping bolt extending through the bowed spring plate and rail restrainer. The spring plate is bowed into an arcuate configuration in a plane parallel to the longitudinal axis of the rail, at least at the edge adjacent the rail, and become flattened during tightening of the clamping bolt drawing the spring plate into compressing engagement with the rail restrainer.

10 Claims, 11 Drawing Figures

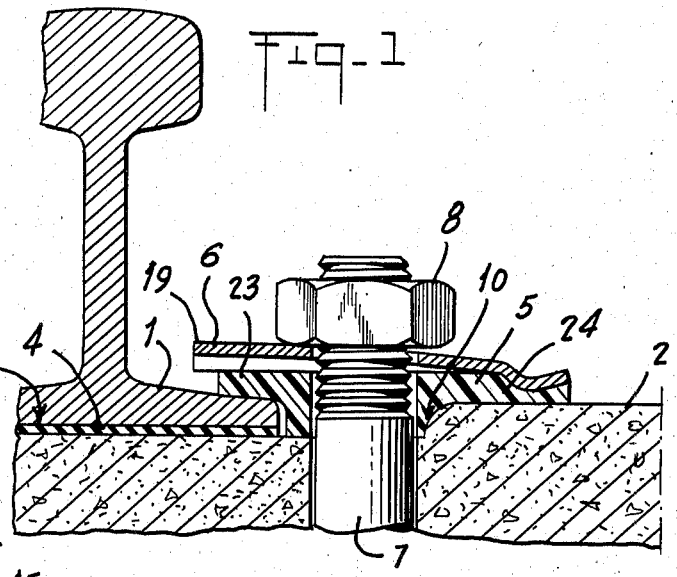
Fig. 1
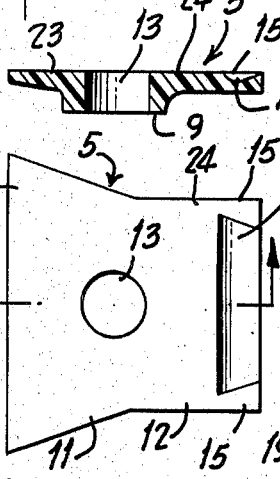
Fig. 3
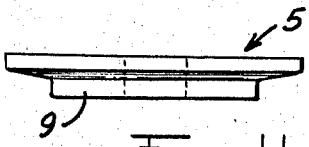
Fig. 4
Fig. 2
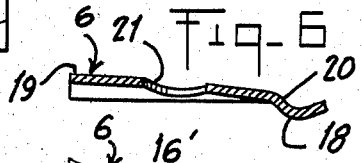
Fig. 6
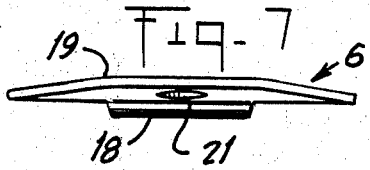
Fig. 7
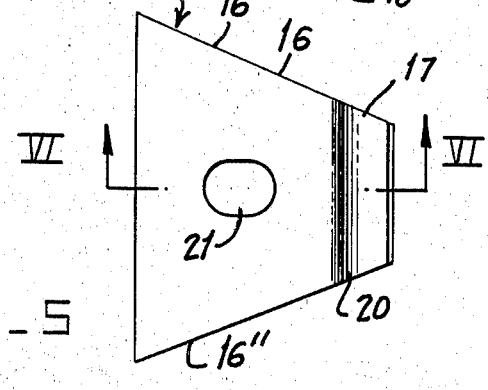
Fig. 5

RESILIENT MOUNTING FOR A RAIL ON ITS SUPPORT

CROSS-REFERENCE TO RELATED APPLICATION

This application is a continuation-in-part of earlier application Ser. No. 914,086 filed Sept. 9, 1978 now abandoned.

BACKGROUND OF THE INVENTION

The present invention concerns the assembly of a rail of a railway track on a rigid support and more particularly the assembly on a concrete sleeper of a long welded rail.

Because of the harsh forces and vibrations which rails must withstand, it is necessary to interpose between the rail and its support an elastic liner, generally of rubber, having a flexibility which permits displacement of the rail with respect to its support. The rail is thus maintained on this support by springs, known as elastic clips, which deform to absorb all its vertical movements. There remain however horizontal components of rail movements which cause wear of the rail and of its clips. It has therefore been considered to dispose, between the clip and the rail, a resilient rail restraining member. As this rail restraining member contributes equally to, on the one hand, electric insulation of the rail and, on the other hand, maintenance of an exact positioning of the rail on the support, it is generally formed of a plastic non-conducting material simultaneously presenting good mechanical strength and electrical resistance while being sufficiently elastic.

Unfortunately, the known rail restraining—or more precisely the systems of elastic clips and rail restraining members known to date—are not wholly satisfactory. For example, it has been found that the rail restraining members often break and that they only partially prevent the phenomenon of tramping of the rail and that the known systems can only be used for the mounting of short lengths of rail, of tunnel trackway or the like. In fact, the positioning of long welded rail, which is the general practice on main lines, can only be achieved in certain temperature conditions for avoiding excessive stresses in the rails by virtue of thermal expansion. When the ambient temperature is too low, it is necessary to heat the rails with the aid of burners. None of the conventional materials used for the rail restraining members can resist the heat generated by the flame of these burners and it is for this reason that on long welded rail the use of resilient liners and rail restrainers is not generally possible.

SUMMARY OF THE INVENTION

The present invention has the aim of overcoming the foregoing disadvantages; it permits the use of rail restrainers of plastic material for the resilient mounting of long welded rails.

Accordingly, this invention provides a resilient mounting for a rail on its support, comprising a flexible liner interposed between the rail and the support; and, to each side of the rail a rail clamp comprising a flexible rail restrainer abutting the rail and the support and extended above the rail flange; a clamping member through this rail restrainer; and a spring plate overlapping the rail restrainer but overhanging therebeyond at least over the rail flange and having a longitudinal edge parallel to and spaced from the rail, said longitudinal edge, in the unclamped state of the mounting, being bowed in a plane parallel to the longitudinal axis of the rail, whereas in the clamped state it is held substantially flat above and out of contact with the rail flange.

In one embodiment, the spring plate overlaps the rail restrainer on the part of the restrainer which is directly above the support, and may equally overhang beyond the rail restrainer above the said part.

With the arrangement of the invention, the flexible rail restrainer is protected from the heat of burners, or the like, by the spring plate which covers the whole restrainer and overhangs the portion of the restrainer above the flange of the rail. Further, the particular bowed form of this spring plate ensures a uniform and elastic clamping of the rail restrainer on the flange. There is thus provided an assembly which (a) permits horizontal and vertical displacements of the base flange of the rail under the effect of forces to which it is subjected, but (b) prevents wear of the rail and, consequently, the risk of fracture.

In a preferred embodiment the rail restrainer on the one hand and the spring plate on the other hand may have characteristic shapes which enable better results to be obtained.

Firstly, the preferred form for the rail restrainer is that in which restrainer has a central body pierced by a hole, and two wings. The central body is intended to engage, on the one hand, the base flange of the rail, and on the other hand, a shoulder of the support, and the wings are intended to extend with one of them on top of the base flange of the rail and the other on the upper face of a shoulder of the support.

The general form of the rail restrainer, for example when viewed from above, is essentially trapezoidal; the longer the two parallel sides of the trapezoid is at the end of the wing of the restrainer which engages the rail base flange; the shorter of the two parallel sides of the trapezoid is the one which bears on the support shoulder. In practice, and for economy of the material constituting the rail restrainer, it is possible for this rail restrainer to have a form resulting from the juxtaposition of (a) a trapezoidal part whose longer parallel side is the one extremely close to the rail base flange and the shorter of whose parallel sides is situated towards the middle of the rail restrainer and (b) a part of generally rectangular form which constitutes the part remote from the rails. This generally trapezoidal form of rail restrainer is important to the extent that, on the one hand, it permits two relatively remote points of engagement of the rail restrainer on the rail whereby it ensures a good transmission of the lateral forces on the rail during passage of trains and also increases, to a surprising extent, the resistance of the rail to the phenomenon of tramping. It is desirable that this rail restrainer should be suitably dimensioned to obtain the results mentioned above. Whereas, with the systems of prior art Patents in which there is used the combination of a plate bowed in a plane perpendicular to the rail and of a corresponding rail restrainer and the restrainer generally had a dimension (parallel to the rail) of the order of 6 cm, it has been found that the rail restrainer of the present application may preferably have a size (dimension of the longer parallel side of the "trapezoid") at least equal to 10 cm and more particularly of the order of 12 to 15 cm.

Furthermore, the upper face of the rail restrainer is substantially planar. However, this upper face has, at the rear end of the restrainer (that is to say the end which rests on the shoulder of the sleeper), a shallow groove and at least one abutment. In a particular embodiment, this abutment will in fact be constituted by two separate abutment platforms situated at the two ends of the groove.

Finally, it is desirable to ensure that the vertical surfaces of this rail restrainer which engage the base flange of the rail and the shoulder of the support, respectively, present substantially equal engagement areas. These engagement areas have a substantially rectangular form. In the preferred embodiment of the invention the lengths of the two rectangles are different by virtue of the general trapezoidal form of the rail restrainer and this implies that the other sides of the two rectangles (in fact the "heights" since when the rail restrainer is in position these engagement areas are substantially vertical) must be different to give the same area to the rectangle; the height of the abutment coming into engagement against the shoulder of the support being greater than the height of the surface engaging the rail flange. By virtue of this suitable dimensioning of the engagement area, it is possible to ensure a better distribution of the internal stresses of the rail restrainer.

The mounting of this invention comprises a spring plate whose form is adapted to the rail restrainer described above.

First of all the bowing of the said spring plate is parallel to the rail. But, further, this bowing is such that it only occurs on the "forward" part of said spring plate, with the result that: (a) the spring plate has, in its forward part which comes to press the wing of the restrainer on the flange of the rail, the form of an arc of an ellipse with a maximum curvature to the bowing at the side of the spring plate which rests on the flange of the rail and a substantially zero bowing at the opposite side of the spring plate; (b) the non-bowed rear part of the spring plate has the form of a shallow groove corresponding exactly with the form of the groove of the rail restrainer such that at any moment (before or after clamping of the spring plate), the rear part of the plate bears on the whole length of the groove on the corresponding groove of the restrainer; (c) the spring plate is provided, in its rear part, with means to cooperate with the abutment or abutments on the rear part of the rail restrainer to prevent the plate from sliding on the restrainer during clamping; thus, if "abutment" of the rail restrainer is constituted by two abutment platforms situated at the two ends of the groove of the restrainer, the corresponding means of the plate may quite simply be constituted by a width of the plate such that, in its upper part corresponding to said groove, the plate is trapped between these two abutments.

Quite clearly, the plate is provided, in its bowed portion, with an opening which corresponds exactly to an opening of the restrainer; as described above, this opening is intended for passage of a stud, anchored in the sleeper, on which pin is threaded a nut which serves to clamp the spring plate on the restrainer. During clamping, the plate, bearing on the two surfaces situated at the two ends of the rail restrainer, undergoes a deformation and comes progressively into contact with this restrainer.

This technique for deformation of an initially bowed plate for bringing it progressively into a substantially flat state has been judged preferable to other techniques in which are used, for example, a restrainer having a bowed upper surface and an initially flat plate which becomes bowed during clamping.

In order that the present invention may more readily be understood the following description is given, merely by way of example, reference being made to the accompanying drawings.

BRIEF DESCRIPTION OF THE DRAWING

FIG. 1 is a transverse sectional view showing a preferred embodiment of resilient mounting in accordance with the invention, placed in position but not clamped;

FIG. 2 is a plan view showing the rail restrainer used in the mounting of FIG. 1;

FIG. 3 is a vertical section through the rail restrainer, in a plane perpendicular to the longitudinal axis of the rail;

FIG. 4 is an elevational view of the rail restrainer, as seen from the rail;

FIG. 5 is a plan view of the spring plate;

FIG. 6 is a vertical section through the spring plate in a plane perpendicular to the longitudinal axis of the rail;

FIG. 7 shows an elevational view of the spring plate, seen from the rail;

DESCRIPTION OF THE PREFERRED EMBODIMENTS

Figure 8:
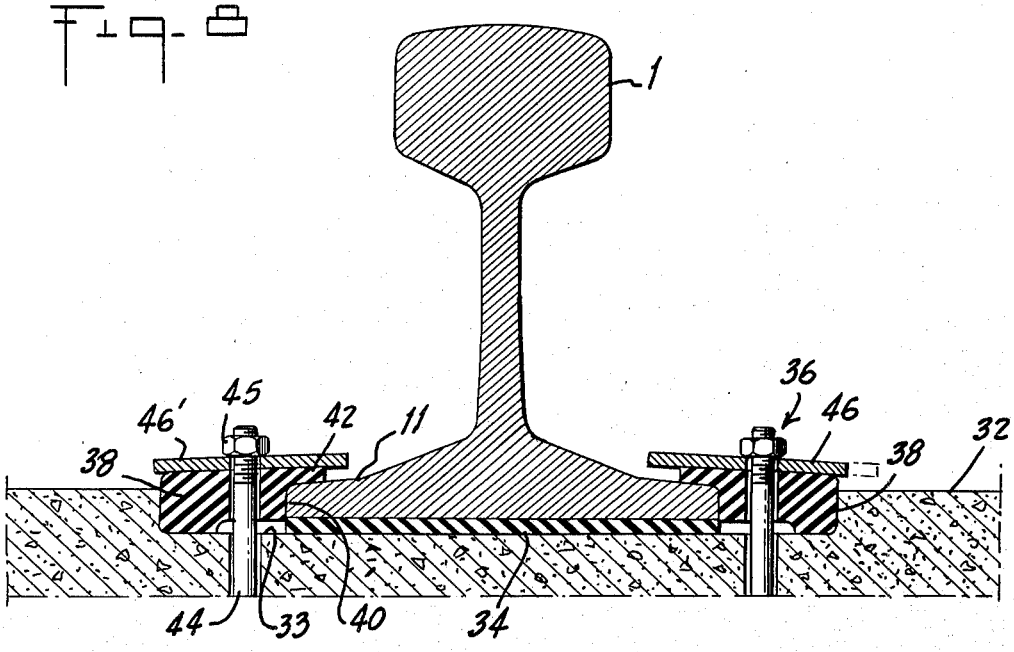
FIG. 8 is a transverse sectional view of an alternative embodiment of resilient mounting in accordance with the invention.

Referring now to FIG. 1, there can be seen, in a section taken perpendicular to the rail axis the rail having a base flange 1 resting on a concrete support or sleeper 2 which has a transverse recess 3 to receive the flange 1, the rail resting on the floor of this recess 3 through the agency of a liner 4 of elastic material, such as rubber.

The resilient mounting elements comprise a non-conducting restrainer 5, formed of elastic material having a high resistance to crushing with the preferred material being nylon or polyacetal resin. The thickness of the restrainer should not be less than 0.5 cm. The restrainer must have sufficient elasticity to follow movement of the rail and cannot be formed of material such as non-vulcanized rubber incapable of resisting high pressure. The restrainer is held down by a metal spring plate 6 under a nut 8 screwed on the threaded part of a clamp stud 7 anchored in the support 2. In FIG. 1, the nut 8 is shown unclamped, and the spring plate 6 is in unstressed condition.

The rail restrainer 5 has both a central body 9 which lies between the rail flange 1, and a shoulder 10 of the support 2, and also two wings 23 and 24. Wing 23 has a width of 10 to 15 cm and bears on the rail flange 1 and has a planar upper surface. Wing 24 conforms to and bears on shoulder 10. The rail restrainer is shown separately in FIGS. 2, 3 and 4.

From FIG. 2, which is a top plan view of the rail restrainer 5, it can be seen that this restrainer has the general form of a trapezoid in that it is constituted by a trapezoidal part 11 and a rectangular part 12 having one longer side common to the shorter of the two parallel sides of the trapezoid. The trapezoidal part 11 of the rail restrainer 5 includes wing 23 which bears on the rail flange 1; the longer of the parallel sides of the trapezoid constitutes the extreme inner edge of the rail restrainer which engages the base flange 1 of the rail and has a length of the order of 14 cm. Towards the center of the restrainer there can be seen the clearance hole 13 for the clamping stud 7.

FIG. 3 shows that the upper face of the restrainer is essentially planar but that, towards the rear of this restrainer, (the term "rear" being applied to wing 24 of the restrainer which bears on the shoulder 10 of the support 2) is a shallow groove 14. Further, at the two ends of this groove 14, the restrainer has two platforms 15 (see FIG. 2).

FIG. 4 is an elevational view (seen from the rail) showing the structure of the restrainer 5.

FIG. 5 is a top plan view of the spring plate, this plate is formed of spring steel and has a trapezoidal form. Its thickness is generally from about 4 to 5 mm; the longer parallel side of the trapezoid overlies the said flange 1, in use, while the part 17 corresponding to the shorter parallel side of the trapezoid lies above the support 2. This part 17 in fact has a downwardly protruding cylindrical lower surface portion 18 (see FIG. 6), positionable in the shallow groove 14 of the rail restrainer. Thus, this cylindrical lower surface 18 matingly fits in and conforms to the corresponding upper surface of the restrainer groove 14. The size of this part 17 is such that it fits exactly between the two platforms 15 (FIG. 2) of the rail restrainer. The dimensions of the spring plate are such that, when the spring plate is positioned as just described with respect to the rail restrainer 5, said plate 6 overhangs inwardly beyond the inner edge of restrainer 5 above the rail flange 1 and has sided edges 16' and 16" which partially overhand beyond the associated sides of the restrainer. In the unstressed state, the spring plate has its forward part 19 bowed in a vertical plane extending parallel to the longitudinal axis of the rail with a zero bowing near its rear part 20; it thus has the form of a portion of an ellipse. As can be seen, the spring plate 6 includes an oval aperture 21 which is aligned with hole 13 of the rail restrainer 5.

Figure 9:
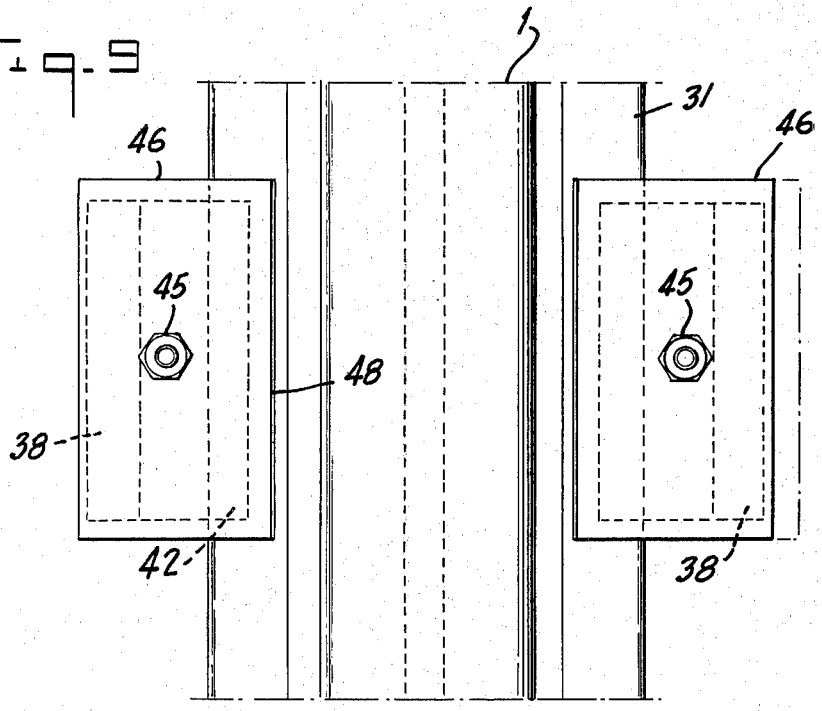
FIG. 9 is a top view of the mounting of FIG. 8.

FIGS. 8 and 9, on the one hand, 10 and 11, on the other hand, show other alternative embodiments of the invention.

FIGS. 8 and 9 again show the rail base flange 31 supported by a concrete sleeper 32 which includes a transverse recess 33 for receiving the said flange. This rail rests on the floor of the recess 33 by the agency of a liner 34 of elastic material, and it is resiliently maintained on the sleeper 32 by mountings generally designated 36, and disposed at each of it sides between the rail and the edge of the recess 33.

Each of the mountings 36 comprises a rail restrainer 38 formed of flexible elastic material identical to that of restrainer 5. Restrainer 38 has an elongate body in abutment against, on the one hand, the edge of the recess 33 and, on the other hand, the edge 40 of the rail flange 31. The body of the rail restrainer 38 is extended at its upper part by a longitudinal flange or wing 42 which is pressed on the upper surface of the base flange of the rail 31. The rail restrainer 38 is penetrated by a clamping member which, in the example illustrated, is a stud 44 anchored in the sleeper 32 and on which a nut 45 is screwed.

The upper surface of the restrainer 38, that is to say the face adjacent the nut 45, is overlaid and covered by a metallic clip 46 in the form of a spring steel plate disposed parallel to the rail 31. The spring plate 46, which preferably has a rectangular form, overhangs beyond the rail restrainer 38 at least over the inner edge of wing 42, that is to say above the flange 31 of the rail. Preferably, this spring plate also overhangs at the opposite end of the rail restrainer 38, above the sleeper 32 as shown in FIG. 9.

Figure 11:
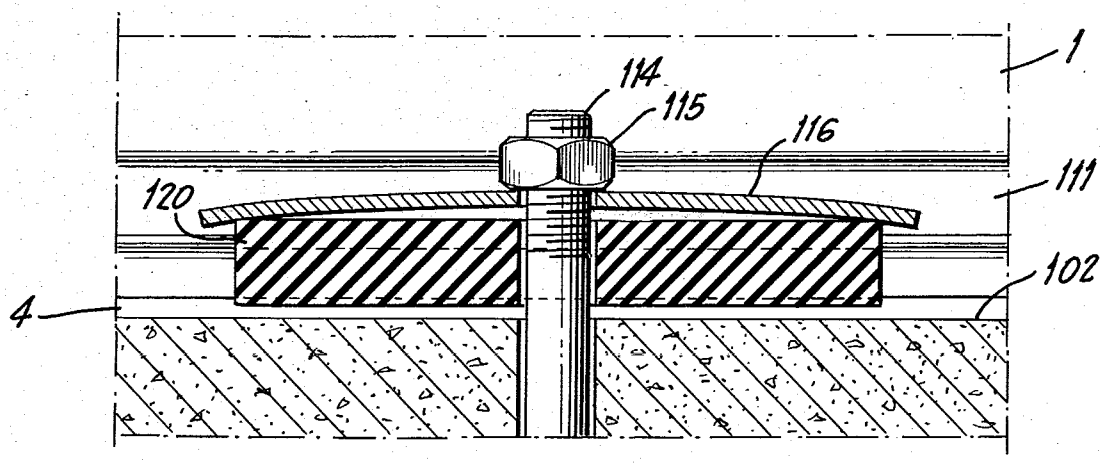
FIG. 11 is a sectional view taken along the line 11—11 of FIG. 10, showing the fixing elements before clamping.

Furthermore, the spring plate 46 is bowed parallel to the rail 31, at least in its part which is above the flange 42 of the restrainer and preferably along all of its longitudinal edge 48 corresponding to its longer side and directed parallel to the rail 31. The concavity of the spring plate 46 is turned towards the rail flange 31 such that, when unstressed, i.e. in the absence of clamping, the spring plate 46 has a configuration analagous to that which is shown in FIG. 11, the spring plate 46 resting on solely the two lateral edges of the rail restrainer 38.

During clamping, the nut 45 flattens the spring plate 46 and uniformly presses it on the upper face of the restrainer 38.

The spring plate 46 is always maintained at a small distance above the rail flange 31 and the sleeper 32.

Of course, the spring plate 46 may be bowed across its whole width and be, for example, constituted by a portion of a cylinder having an axis perpendicular to the direction of the rail.

While it is relatively important that spring plate 46 overhangs beyond the edge 42 of the rail restrainer 38, at the side toward the rail, it is acceptable for it to overhang only very slightly at the opposite side (above the sleeper 32) as represented on the lefthand part of FIG. 8, or to a much greater extent as shown in the righthand part of this same FIG. 8. In all these cases, the spring plate 46 overlaps totally at least the portion of the rail restrainer which is in the recess 3 and above the rail flange 31. Consequently, the plate 46 insulates this restrainer 38 thermally from all heating members, such as oxyacetylene welding torches or other burners, which may be used during or following installation of the rail 31 to heat the rail to a temperature higher than the ambient temperature.

Figure 10:
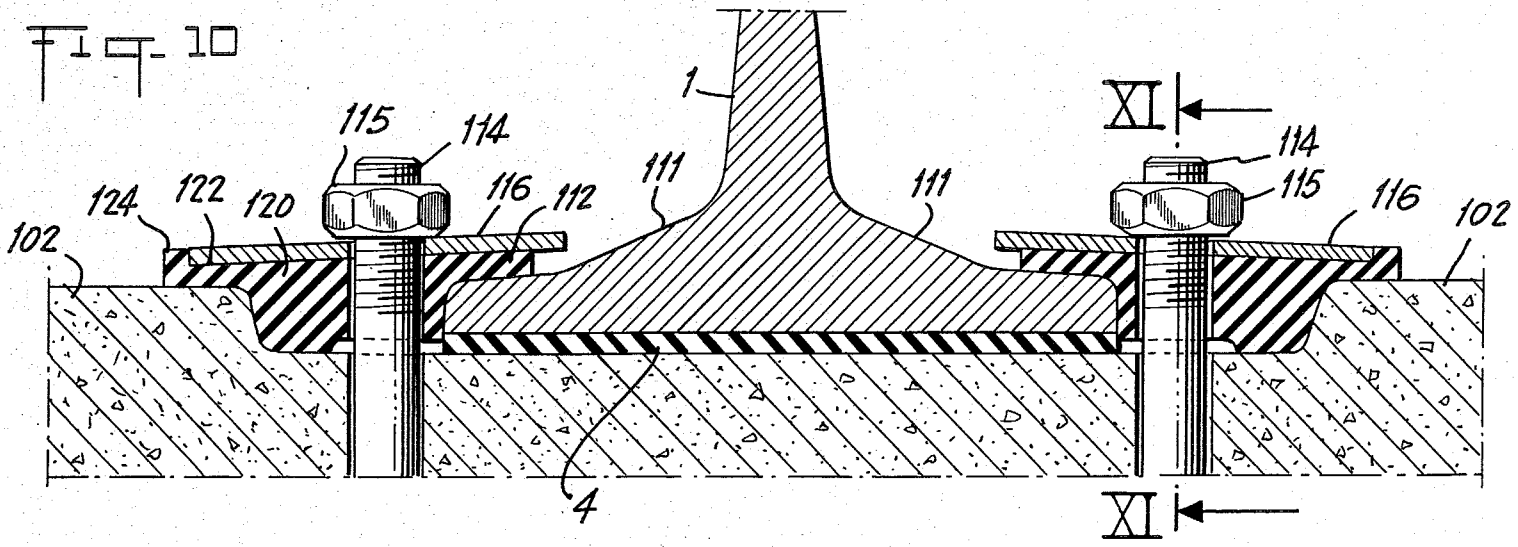
FIG. 10 is a view analagous to FIG. 8, but showing another alternative embodiment.

In an alternative embodiment, illustrated in FIG. 10, the mounting comprises a rail restrainer 120 which has a flange 122 beyond the sleeper recess to rest on the top surface of the sleeper 102. This flange 122 is analagous to flange 112 bearing on the rail 111. The spring plate 116 overlaps this edge 122. Preferably, as in this case, the flange 122 is provided with a longitudinal end rib 124 which forms an abutment for the longitudinal edge of the spring plate 116, to hold the plate 116 against rotation, which is particularly important during clamping of the nut 115 on the stud 114.

In this embodiment, as in the preceding embodiments, the mounting ensures, by virtue of the combination of the rail restrainer 120 with the spring plate 116, and by virtue of the particular form of these two members, a resilient mounting with a relatively important bearing surface on the rail flange and a uniform clamping action, without any contact however of the metallic spring plate 116 with the rail flange; thus there is no risk of wear or fracture of the rail.

Such a device is more particularly adapted for use on long welded rails, since the rail restrainer is insulated and protected from the flame of a burner or any other means associated with the rail for heating the rail; furthermore all movement, either vertical or horizontal, may be damped by the presence of the elastic liner under the rail flange and the flexible rail restrainer above the flange to maintain the rail fixed in place.

I claim:

1. A resilient mounting for a rail having a base flange resting on a support, said mounting comprising flexible liner means interposed between said base flange and said support and first and second rail clamp means respectively mounted on said support and engaging opposite sides of the base flange and each of said rail clamp means comprising:

(a) flexible rail restrainer means formed of material having essentially the same physical characteristics as nylon and having an upper surface and a lower surface with the lower surface engaging the upper surface of the base flange of a rail;

(b) a spring plate having upper and lower surfaces overlapping said flexible rail restrainer means and having a longitudinal edge overhanging inwardly beyond the portion of the rail restrainer engaging the base flange of the rail;

(c) clamping means extending through said flexible rail restrainer means and the spring plate for providing a downward clamping force to said spring plate; said longitudinal edge of said spring plate being parallel to and spaced above said rail and including an outer edge remotely positioned transversely from said base flange, wherein said longitudinal edge, in the unclamped state of the plate, is bowed in a plane parallel to the longitudinal axis of the rail but assumes a planar orientation upon actuation of said clamping means so that its lower surface flatly contacts the upper surface of the portion of the flexible rail restrainer means engaging the base flange so that the flexible rail restrainer forcefully engages the base flange to provide enhanced resistance to longitudinal movement of the rail.

2. A mounting according to claim 1 wherein said outer edge of said spring plate overhangs beyond the flexible rail restrainer means and extends above the support at a location transversely spaced outwardly from the rail.

3. A mounting according to claim 1, wherein said flexible rail restrainer means has a flange which overlies the support above the support and has a distal end spaced from said rail with said flange having abutment means at its distal end engaging said spring plate to immobilize said spring plate against rotation about a vertical axis.

4. A mounting according to any one of the claims 1, 2 or 3 further including a downwardly extending recess in said support, said base flange being mounted in said downwardly extending recess, wherein said flexible rail restrainer means engages both the base flange of the rail and an edge of said downwardly extending recess.

5. A mounting according to any one of the claims 1, 2 or 3 wherein said flexible rail restrainer means comprises an elongated body having a larger dimension parallel to the rail, the spring plate having a substantially rectangular form and a width slightly larger than the width of the flexible rail restrainer means.

6. A mounting according to any one of claims 1, 2 or 3 wherein said flexible rail restrainer means and the spring plate have the general form of a trapezoid when viewed in plan, said trapezoid having two parallel sides of which the longer is disposed above the base flange.

7. A mounting according to claim 3, wherein said flexible rail restrainer means has a groove in its upper surface which defines said abutment means at its distal end engaging said spring plate to immobilize said spring plate against rotation and wherein said spring plate means also has a shallow downwardly extending protrusion matingly received in the recess of the flexible rail restrainer means so as to preclude rotation of said spring plate.

8. A mounting according to claim 1 wherein said flexible rail restraining means is formed of polyacetal resin.

9. A mounting according to claim 1 wherein said outer edge of said spring plate is above and substantially in alignment with an outer end edge of said flexible rail restrainer means.

10. The combination of a support, a rail having a base flange resting on said support, a resilient mounting for said rail comprising flexible liner means interposed between said base flange and said support and first and second rail clamp means respectively engaging opposite sides of the base flange with each of said rail clamp means comprising:

(a) a flexible rail restrainer means formed of nylon or the like material and having an upper surface and a lower surface engaging the upper surface of the base flange of the rail;

(b) a spring plate having upper and lower surfaces overlapping said flexible rail restrainer means and having a longitudinal edge overhanging inwardly beyond the portion of the rail restrainer engaging the base flange;

(c) threaded clamping means extending through said support, said flexible rail restrainer means and said spring plate providing a downward clamping force to the spring plate; said longitudinal edge of said spring plate being parallel to and spaced above said rail and including an outer edge remotely positioned transversely from said base flange, wherein said longitudinal edge in the unclamped state of the plate is bowed in a plane parallel to the longitudinal axis of the rail but assumes a linear orientation when clamped so that its lower surface engages the upper surface of the portion of the flexible rail restrainer means engaging the base flange in response to the actuation of said clamping means so as to forcefully restrain the base flange of the rail to provide enhanced resistance to longitudinal movement of the rail.

* * * * *